US010513314B2

(12) United States Patent
Parniske et al.

(10) Patent No.: US 10,513,314 B2
(45) Date of Patent: Dec. 24, 2019

(54) SELF-SUPPORTING BIMINI TOP

(71) Applicant: Taylor Made Group, LLC, Gloversville, NY (US)

(72) Inventors: Dennis J. Parniske, Parrish, FL (US); Robert R. Shearer, Bradenton, FL (US)

(73) Assignee: TAYLOR MADE GROUP, LLC, Gloversville, NY (US)

( * ) Notice: Subject to any disclaimer, the term of this patent is extended or adjusted under 35 U.S.C. 154(b) by 0 days.

(21) Appl. No.: 15/486,486

(22) Filed: Apr. 13, 2017

(65) Prior Publication Data

US 2017/0297654 A1 Oct. 19, 2017

Related U.S. Application Data

(60) Provisional application No. 62/322,368, filed on Apr. 14, 2016.

(51) Int. Cl.
*B63B 17/02* (2006.01)

(52) U.S. Cl.
CPC ..... *B63B 17/02* (2013.01)

(58) Field of Classification Search
CPC ..... B63B 17/02; E04H 15/06
USPC ..... 135/88.01; 114/361
See application file for complete search history.

(56) References Cited

U.S. PATENT DOCUMENTS 2,817,345 A * 12/1957 Woodruff, Sr. ..... B63B 17/02 114/361
5,303,667 A * 4/1994 Zirkelbach ..... B63B 17/02 114/361
5,520,139 A * 5/1996 King ..... B63B 17/02 114/361
5,743,208 A * 4/1998 Miller ..... B63B 17/02 114/361
5,803,104 A * 9/1998 Pollen ..... B63B 17/02 114/361
5,931,114 A * 8/1999 Bartholomew ..... B63B 17/02 114/361
6,006,692 A * 12/1999 Szukhent, Jr. ..... B63B 17/02 114/361
6,327,993 B1 12/2001 Richens, Jr.
6,637,364 B1 * 10/2003 Campeau ..... B63B 17/02 114/361
6,711,783 B2 * 3/2004 LeMole ..... B60J 7/1204 114/361
6,820,569 B2 * 11/2004 Warfel ..... B63B 17/02 114/361
6,848,387 B1 2/2005 Zalanka
6,907,642 B1 6/2005 Czipri
6,983,716 B1 1/2006 Ankney et al.
7,040,587 B2 5/2006 Thompson et al.
7,370,597 B1 5/2008 Schwindaman
(Continued)

*Primary Examiner* — Noah Chandler Hawk
(74) *Attorney, Agent, or Firm* — Nixon & Vanderhye P.C.

(57) ABSTRACT

A self-supporting bimini top frame is independently supportable on four contact points. A main bow defines a first support member for a bimini top connectable to the bimini top frame. The main bow defines first and second contact points. A pair of stanchions are pivotably connected to the main bow and define third and fourth contact points. A primary tension bow is pivotably and slidably connected to the main bow and defines a second support member for the bimini top. A bimini top may also be secured on the bimini top frame.

14 Claims, 5 Drawing Sheets

(56) References Cited

U.S. PATENT DOCUMENTS

| | | | | |
|---|---|---|---|---|
| 7,430,980 | B2 | 10/2008 | Fishburn | |
| 7,490,574 | B2 * | 2/2009 | Shearer | B63B 17/02 114/343 |
| 7,571,691 | B2 | 8/2009 | Russikoff | |
| 7,921,797 | B2 | 4/2011 | James | |
| 7,950,342 | B2 | 5/2011 | Russikoff | |
| 8,752,498 | B1 * | 6/2014 | Schwindaman | B63B 17/02 114/361 |
| 9,027,500 | B2 | 5/2015 | Williams et al. | |
| 9,096,291 | B2 | 8/2015 | Perosino et al. | |
| 9,139,259 | B2 | 9/2015 | Williams et al. | |
| 9,604,702 | B2 * | 3/2017 | Hough | E04H 15/48 |
| 2010/0083891 | A1 * | 4/2010 | Russikoff | B63B 17/02 114/361 |
| 2017/0073859 | A1 * | 3/2017 | Cantin | D04B 1/10 |

* cited by examiner

SELF-SUPPORTING BIMINI TOP

CROSS-REFERENCES TO RELATED APPLICATIONS

This application claims the benefit of U.S. Provisional Patent Application No. 62/322,368, filed Apr. 14, 2016, the entire content of which is herein incorporated by reference.

STATEMENT REGARDING FEDERALLY SPONSORED RESEARCH OR DEVELOPMENT (NOT APPLICABLE)

BACKGROUND

The invention relates to a self-supporting bimini top and, more particularly, to a bimini top with fewer connection points and fewer sight obstacles that is easily stowed.

A bimini top is traditionally an open-front cover assembly including a top made of canvas or other suitable material for the cockpit of a vehicle such as a boat. The traditional bimini top typically utilizes six points of contact on the boat or other support structure. In addition to metal supporting tubes, the traditional bimini top includes one or more connections between the front/rear corners of the top and the boat. The connections, however, create added obstructions with respect to getting on and off the boat, create visual obstructions, and tend to flutter in the wind creating undesirable noise.

BRIEF SUMMARY

The system according to the described embodiments is designed to overcome some of these drawbacks. Specifically, the system utilizes only four points of contact. The system also enables the user to store and/or deploy the top without requiring the user to disengage any part of the bimini top structure. To stow the top, a tension bow can be easily released so as to be slid down a main support leg of the top, and the top is then foldable onto itself. A plastic sleeve inside of a jaw slide on the tension bow prevents scratching or marring of the main support leg and creates smooth action.

A rear/front stanchion acts as a leveling and stabilizing connection and is secured at both ends with an eye end, possibly including a threaded hole. The eye end is secured in a fixture, and with a suitable fastener (such as a threaded fastener if the eye end is also threaded), the stanchions can be locked down, eliminating potential rattle. The stanchion may be adjustable so that the top can be selectively positioned. The entire bimini may also be completely released so that the top can be used as a temporary cabana or the like. The top construction may similarly be used as a permanent cabana and/or a sprayhood/dodger using the deck as a third tension bow The top also includes stretchable bow pockets. The stretchable fabric or fabric insert permits the top material to stretch during storage and deployment of the top. The stretchable bow pockets provide for smooth motion and eliminate a potential ripping point in the top.

In an exemplary embodiment, a self-supporting bimini top frame includes a main bow defining a first support member for a bimini top connectable to the bimini top frame and defining first and second contact points, and a pair of stanchions pivotably connected to the main bow and defining third and fourth contact points. A primary tension bow is pivotably and slidably connected to the main bow and defines a second support member for the bimini top. The first through fourth contact points are the only contact points needed for supporting the bimini top frame.

The stanchions may be adjustable, e.g., the stanchions may be selectively adjustable telescopically between an extended position and a retracted position. The primary tension bow may include a pair of jaw slides coupled with the main bow, and a bushing may be disposed between the jaw slides and the main bow.

The frame may also include a secondary tension bow pivotably connected to the main bow and defining a third support member for the bimini top positionable between the main bow and the primary tension bow. The primary tension bow and, if included, the secondary tension bow may be pivotable between an extended position and a retracted position, where pivot angles between the primary tension bow and the main bow and between the secondary tension bow and the main bow may be smaller in the retracted position.

The frame may also include a pair of connector arms pivotably secured between the main bow and the primary tension bow. The connector arms may be pivotable with the primary tension bow relative to the main bow.

In some embodiments, the main bow may be a first U-shaped member, where a closed bottom of the first U-shape defines the first support member for the bimini top, and where open ends of the first U-shape define the first and second contact points. The primary tension bow may be a second U-shaped member, where a closed bottom of the second U-shape defines the second support member for the bimini top.

The first through fourth contact points may comprise a threaded eye for receiving a threaded connector.

In another exemplary embodiment, a self-supporting bimini top assembly includes the bimini top frame of the described embodiments and a bimini top secured on the bimini top frame. The bimini top extends from the first support member to the second support member. The bimini top may include a main bow sleeve and a primary tension bow sleeve, where the main bow is threaded through the main bow sleeve, and where the primary tension bow is threaded through the primary tension bow sleeve. At least a portion of the main bow sleeve and the primary tension bow sleeve may be formed of a stretchable material that permits the bimini top to stretch during storage and deployment of the bimini top. The bimini top frame may further include the secondary tension bow pivotably connected to the main bow, where the bimini top includes a secondary tension bow sleeve, and where the secondary tension bow is threaded through the secondary tension bow sleeve.

In yet another exemplary embodiment, a self-supporting bimini top frame is independently supportable on four contact points. A U-shaped main bow includes a first contact point, a first leg extending from the first contact point, a first curved section extending from the first leg, a first cross support member extending from the first curved section, a second curved section extending from the first cross support member, a second leg extending from the second curved section, and a second contact point at a distal end of the second leg. The first cross support member defines a first support member for a bimini top connectable to the bimini top frame. A pair of stanchions are pivotably connected to first leg and the second leg of the main bow, respectively, and define third and fourth contact points. A U-shaped primary tension bow includes a first pivot connection pivotably and slidably connected to the first leg of the main bow, a first frame member extending from the first pivot connection, a first bent section extending from the first frame member, a second cross support member extending from the first bent section, a second bent section extending from the second cross member, a second frame member extending from the second bent section, and a second pivot connection pivotably and slidably connected to the second leg of the main bow. The second cross support member defines a second support member for the bimini top.

BRIEF DESCRIPTION OF THE DRAWINGS

These and other aspects and advantages will be described in detail with reference to the accompanying drawings, in which.

DETAILED DESCRIPTION

Figure 1:
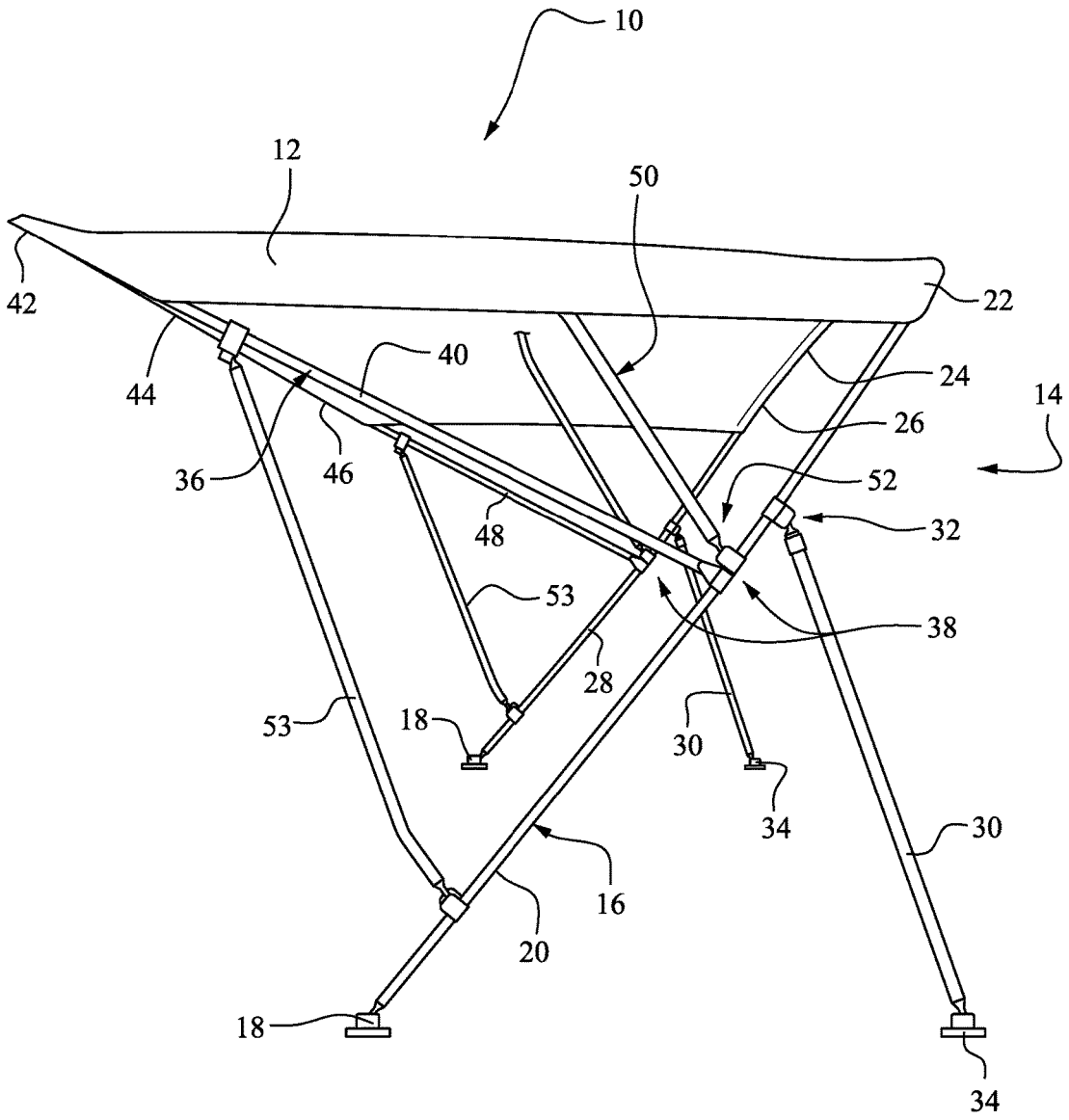
FIG. 1 is a side view of the self-supporting bimini top assembly according to the described embodiments.

FIG. 1 is a side view of a self-supporting bimini top assembly 10. A bimini top 12 is secured on a bimini top frame 14. The frame 14 includes a main bow 16 that has first and second contact points 18. The parts and members of the bimini top frame 14 can be made from aluminum or stainless steel or some other suitable material. Generally, the main bow 16 is substantially U-shaped and includes a first leg 20 extending from a contact point 18, and a first curved or bent section 22 extending from the first leg 20. A first cross support member 24 extends from the first curved or bent section 22, and a second curved or bent section 26 extends from the first cross support member 24. A second leg 28 extends from the second curved or bent section 26, and the contact point 18 is disposed at a distal end of the second leg 28. As shown, the cross support member 24 and possibly also the curved or bent sections 22, 26 define a support member for the bimini top 12 connectable to the bimini top frame 10. A closed bottom of the U-shape of the main bow 16 defines the first support member for the bimini top, and open ends of the U-shape define the first and second contact points 18.

A pair of stanchions 30 are pivotably connected to the main bow 16. Specifically, the stanchions 30 are connected via a pivot joint 32 to the first leg 20 of the main bow 16. The stanchions 30 define third and fourth contact points 34 for the frame 10. In use, the bimini top frame 14 is independently supportable on the four contact points 18, 34. That is, the four contact points 18, 34 are the only contact points needed for supporting the bimini top assembly 10.

A primary tension bow 36 is pivotably and slidably connected to the main bow 16. The primary tension bow 36 is substantially U-shaped and includes a first pivot connection 38 pivotably and slidably connected to the first leg 20 of the main bow 16. A first frame member 40 extends from the first pivot connection 38, and a first curved or bent section 42 extends from the first frame member 40. A cross support member 44 extends from the first bent section 42, and a second bent section 46 extends from the second cross member 44. A second frame member 48 extends from the second bent section 46, and a second pivot connection 38 is pivotably and slidably connected to the second leg 28 of the main bow 16. The cross member 44 and possibly also the curved or bent sections 42, 46 define a second support member for the bimini top 12. That is, the closed bottom of the U-shape of the primary tension bow 36 defines the second support member for the bimini top 12.

A secondary tension bow 50 may be pivotably connected to the main bow 16 via a pivot joint 52. As shown, the secondary tension bow 50 is substantially U-shaped and defines a third support member for the bimini top 12. In the expanded position shown in FIG. 1, the crossbar of the secondary tension bow 50 is positioned essentially midway between the cross support members 24, 44 of the main bow 16 and the primary tension bow 36, respectively. Still additional tension bows may be added. With a third tension bow, the assembly would be a 4-bow bimini.

The frame 14 may also include a pair of connector arms 53 respectively secured between the main bow 16 and the primary tension bow 36 as shown in FIG. 1. The connector arms 53 may be pivotable at both ends.

Figure 2:
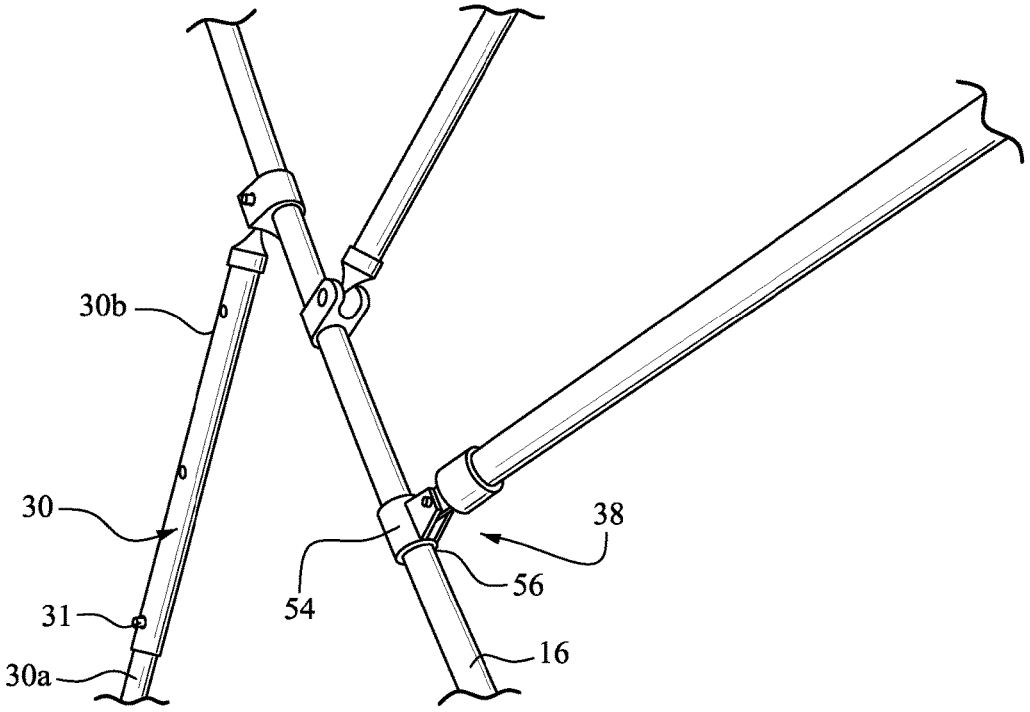
FIG. 2 is a close-up view of parts of the assembly.

The stanchions 30 may be height adjustable to vary an orientation of the bimini top 12 during use. As shown in FIG. 2, the stanchions 30 may be selectively adjustable telescopically between an extended position and a retracted position via telescoping components 30*a*, 30*b* using a spring-biased pin 31 coupled with an inner component 30*a* and selectively engageable in openings in an outer component 30*b*.

Figure 3:
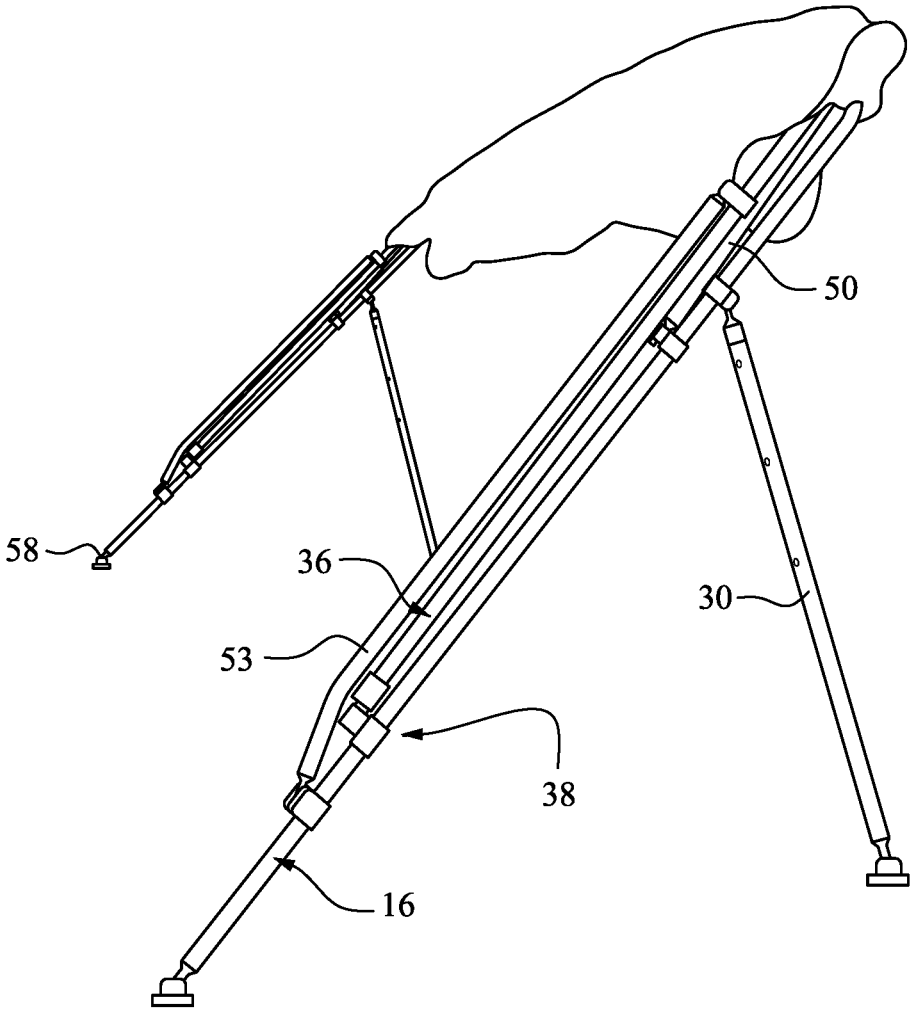
FIG. 3 shows the assembly in a folded or retracted position.

With continued reference to FIG. 2, the pivot connections 38 between the primary tension bow 36 and the main bow 16 may utilize jaw slides 54 and a bushing 56 such as a plastic bushing disposed between the jaw slides 54 and the main bow 16. The bushings 56 prevent scratching or marring of the main bow 16 and facilitate a smooth sliding action when displacing the assembly 10 between the expanded and retracted positions. In order to stow the assembly from the expanded position shown in FIG. 1 to the retracted position shown in FIG. 3, the primary tension bow 36 is released at the pivot connections 38, and the pivot connections 38 are slid down the legs 20, 28 of the main bow 16. As the jaw slides 54 approach the pivot connections of the connector arms 53, the connector arms 53, the primary tension bow 36 and the secondary tension bow 50 are pivoted (clockwise in FIG. 1) into the orientation shown in FIG. 3.

The contact points 18, 34 may be provided with a threaded eye 58 that is securable in a fixture and can be locked down with a threaded fastener. The secure connection may serve to reduce the potential of a rattling noise during use. Additionally, due to the independent support capability of the four contact points 18, 34, the entire assembly 10 may be completely released/detached and used as a temporary cabana or the like. That is, the assembly 10 is self-supporting and is standable in the configuration shown in FIG. 1, for example, without being attached to a boat or other structure. The stanchions 30 can be adjusted as desired to block the sun or the like when used as a cabana.

Figure 4:
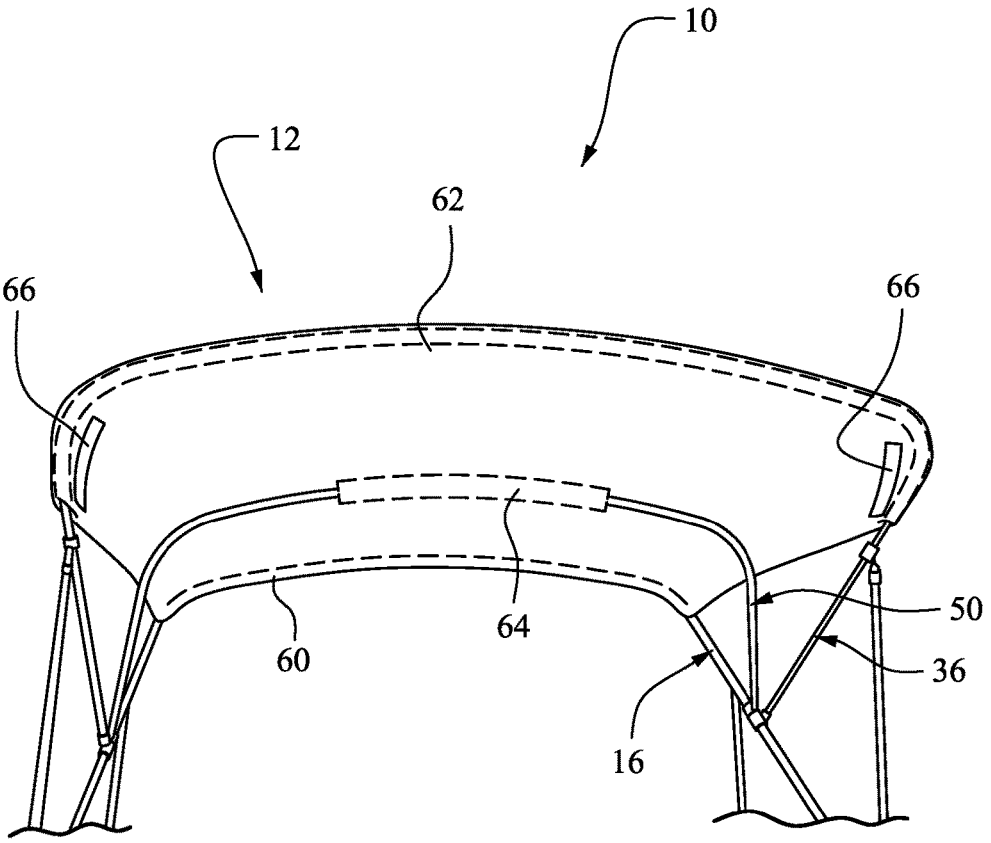
FIG. 4 is a front perspective view of the assembly.

FIG. 4 is a front perspective view of the bimini top assembly 10 showing an underside of the bimini top 12 with the bimini top frame 14 in its extended position. The bimini top 12 includes a plurality of sleeves through which the main and tension bows are threaded. Specifically, the bimini top 12 includes a main bow sleeve 60 and a primary tension bow sleeve 62. The bimini top 12 may also include a secondary tension bow sleeve 64. The main bow 16 is threaded through the main bow sleeve 60, and the primary tension bow 36 is threaded through the primary tension bow sleeve 62. If applicable, the secondary tension bow 50 is threaded through the secondary tension bow sleeve 64.

The bimini top 12 may be provided with stretchable bow pockets 66. The stretchable fabric of the bow pockets 66 permits the top material to stretch during storage and deployment of the bimini top 12. The stretchable bow pockets 66 provide for smooth motion and eliminate a potential ripping point in the bimini top 12.

Figure 5:
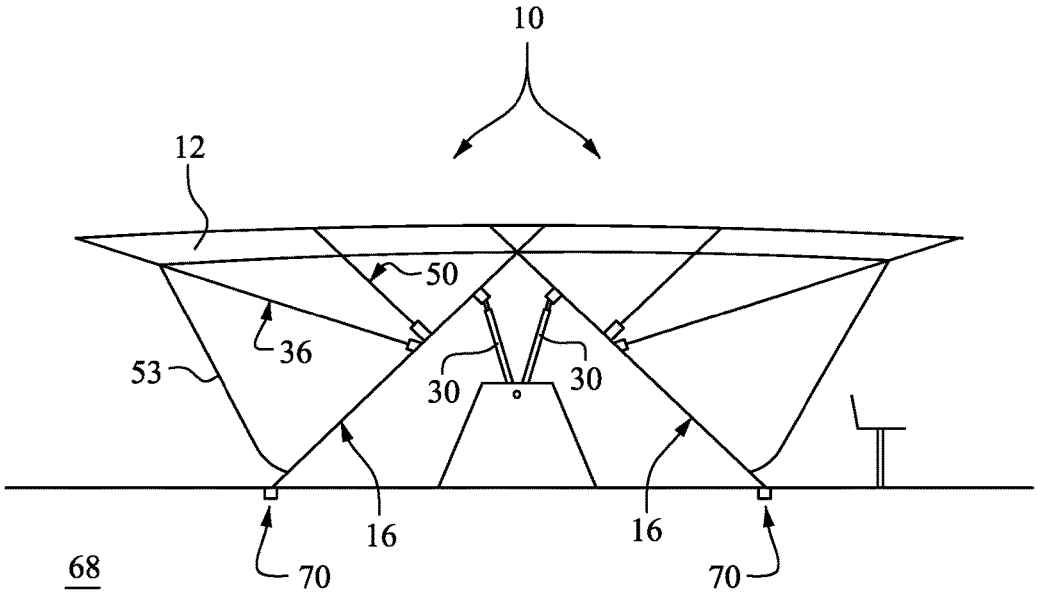
FIG. 5 shows an exemplary application where the assembly can be mounted in different orientations.

With reference to FIG. 5, the assembly 10 can be mounted in a forward facing or rearward facing orientation, depending on user preference, boat style, etc. The boat or other supporting structure 68 can be provided with alternative mounts 70 to which the first and second contact points 18 of the main bow 16 are selectively attachable. The stanchions 30 can be secured to a similar attachment point on the boat deck or support structure 68 or can be secured to an elevated connection point as shown in FIG. 5. In fact, the design is suitable for attachment to various combinations of connection points including, for example, all four points on the support deck, two points on the support deck and two points on the windshield, all four points on the windshield, two points on the windshield and two points on an arch or other structure, all four points on other structure/tower, etc.

The self-supporting assembly of the described embodiments allows for attachment points to remain connected while the bimini top is deployed or stowed. To stow the top from the deployed position, the push/safety pin located below the jaw slides is pressed, and the jaw slides are slid over the pin. This action occurs on both port and starboard sides of the assembly. The jaw slides on each side, together or one at a time are slid downward along the legs of the main bow. There may be a position, on both sides, where the force required to slide the jaw slides increases. Pushing past that position allows the primary tension bow to fold to the stowed position. This procedure is reversed to deploy the top from the stowed position.

The sliding action of the jaw slides along the main bow is facilitated with minimal scratching of the main bow by a polymer sleeve or bushing located between the jaw slides and the main bow. The sleeve or bushing is inserted into the jaw slide, and the sleeved jaw slide assembly is attached to the tubing. Once the tubing is inserted into the sleeved jaw slide, the sleeve is generally not removable unless the tubing is removed or damage occurs to either the jaw slide or the sleeve.

The self-supporting assembly can be used as a forward and/or rear facing bimini top. The same top can be removed from the mounts, rotated 180° and re-mounted to the supporting structure facing in the opposite direction. The attitude of the assembly can be changed using the adjustable stanchions to allow the top to protect the boat occupants from varying sun, wind or rain conditions. The top could be rotated forward, where the main bow is laid onto or near the boat deck, thereby serving as a "dodger" or forward facing protection structure. The assembly could be completely removed from the boat and remounted off the boat on dry land or a dock structure. The assembly could be completely removed from the boat and oriented with the main bow laying on a beach or ground to serve as a protective cabana structure.

The self-supporting top design allows for more open and unobstructed space on the boat. Fewer mounting points allow for clearer view for navigation, easier ingress and egress, and additional unobstructed space for fishing. The assembly also results in reduced wind noise since the straps are eliminated and the number of supports is reduced.

The self-supporting assembly utilizes a flexible material on the pivoting (forward) portion of the top, to allow for the top to fold with minimal stress to the fabric. The assembly provides a stable and repeatable structure that allows the fabric top to deploy to the same position every time. The structure results in a bimini top assembly that aesthetically looks the same at each deployment.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

The invention claimed is:

1. A self-supporting bimini top frame comprising:

a main bow defining a first support member for a bimini top connectable to the bimini top frame and defining first and second contact points, the main bow terminating at the first and second contact points, the main bow being directly engageable with the bimini top;

a pair of stanchions pivotably connected at respective first pivot points to the main bow and defining third and fourth contact points;

a primary tension bow pivotably and slidably connected at respective second pivot points to the main bow and defining a second support member for the bimini top, the primary tension bow being directly engageable with the bimini top; and a secondary tension bow pivotably connected at respective third pivot points to the main bow and defining a third support member for the bimini top positionable in engagement with the bimini top between the main bow and the primary tension bow, wherein the third pivot points are positioned directly between the first and second pivot points, wherein the first through fourth contact points are the only contact points needed for supporting the bimini top frame.

2. A self-supporting bimini top frame according to claim 1, wherein the stanchions are adjustable.

3. A self-supporting bimini top frame according to claim 2, wherein the stanchions are selectively adjustable telescopically between an extended position and a retracted position.

4. A self-supporting bimini top frame according to claim 1, wherein the primary tension bow comprises a pair of jaw slides coupled with the main bow, and wherein a bushing is disposed between the jaw slides and the main bow.

5. A self-supporting bimini top frame according to claim 1, wherein the primary tension bow and the secondary tension bow are pivotable between an extended position and a retracted position, and wherein pivot angles between the primary tension bow and the main bow and between the secondary tension bow and the main bow are smaller in the retracted position.

6. A self-supporting bimini top frame according to claim 1, wherein the primary tension bow is pivotable between an extended position and a retracted position, and wherein a pivot angle between the primary tension bow and the main bow is smaller in the retracted position.

7. A self-supporting bimini top frame according to claim 1, wherein the main bow is a first U-shaped member, wherein a closed bottom of the first U-shape defines the first support member for the bimini top, and wherein open ends of the first U-shape define the first and second contact points.

8. A self-supporting bimini top frame according to claim 7, wherein the primary tension bow is a second U-shaped member, and wherein a closed bottom of the second U-shape defines the second support member for the bimini top.

9. A self-supporting bimini top frame according to claim 1, wherein the first through fourth contact points comprise a threaded eye for receiving a threaded connector.

10. A self-supporting bimini top assembly comprising:

a bimini top frame including:

a main bow defining a first support member for a bimini top connectable to the bimini top frame and defining first and second contact points, a pair of stanchions pivotably connected to the main bow and defining third and fourth contact points, and a primary tension bow pivotably and slidably connected to the main bow and defining a second support member for the bimini top, wherein the first through fourth contact points are the only contact points needed for supporting the bimini top frame; and a bimini top secured on the bimini top frame, the bimini top extending from the first support member to the second support member, wherein the bimini top frame is displaceable between an extended position and a retracted position, and wherein in the extended position, the stanchions and the primary tension bow are connected to the main bow at a position closer to the bimini top than to the first and second contact points.

11. A self-supporting bimini top assembly according to claim 10, wherein the bimini top comprises a main bow sleeve and a primary tension bow sleeve, wherein the main bow is threaded through the main bow sleeve, and wherein the primary tension bow is threaded through the primary tension bow sleeve.

12. A self-supporting bimini top assembly according to claim 11, wherein at least a portion of the main bow sleeve and the primary tension bow sleeve is formed of a stretchable material that permits the bimini top to stretch during storage and deployment of the bimini top.

13. A self-supporting bimini top assembly according to claim 11, wherein the bimini top frame further comprises a secondary tension bow pivotably connected to the main bow and defining a third support member for the bimini top positionable between the main bow and the primary tension bow, wherein the bimini top further comprises a secondary tension bow sleeve, and wherein the secondary tension bow is threaded through the secondary tension bow sleeve.

14. A self-supporting bimini top assembly according to claim 10, wherein the primary tension bow comprises a pair of jaw slides coupled with the main bow, and wherein a bushing is disposed between the jaw slides and the main bow.

* * * * *